US009673553B1

(12) United States Patent
Upson

(10) Patent No.: US 9,673,553 B1
(45) Date of Patent: Jun. 6, 2017

(54) TERMINAL POSITION ASSURANCE LOCKING MECHANISM AND METHOD FOR OPERATING THEREOF

(71) Applicant: J.S.T. Corporation, Farmington Hills, MI (US)

(72) Inventor: Gwendolyn Upson, Farmington Hills, MI (US)

(73) Assignee: J.S.T. CORPORATION, Farmington Hills, MI (US)

( * ) Notice: Subject to any disclaimer, the term of this patent is extended or adjusted under 35 U.S.C. 154(b) by 0 days.

(21) Appl. No.: 15/135,803

(22) Filed: Apr. 22, 2016

(51) Int. Cl.
*H01R 13/426* (2006.01)
*H01R 107/00* (2006.01)

(52) U.S. Cl.
CPC ..... *H01R 13/426* (2013.01); *H01R 2107/00* (2013.01)

(58) Field of Classification Search
CPC ..... H01R 13/426; H01R 2107/00
USPC ..... 439/752, 595, 157, 733.1
See application file for complete search history.

(56) References Cited

U.S. PATENT DOCUMENTS 5,252,096 A * 10/1993 Okada ..... H01R 13/4362 439/752
6,010,374 A * 1/2000 Miwa ..... H01R 13/4362 439/752
6,036,552 A * 3/2000 Atsumi ..... H01R 13/4362 439/752
6,648,699 B1 * 11/2003 Makino ..... H01R 13/4362 439/595
6,902,443 B2 * 6/2005 Hara ..... H01R 13/4362 439/752

* cited by examiner

*Primary Examiner* — Edwin A. Leon
(74) *Attorney, Agent, or Firm* — Kratz, Quintos & Hanson, LLP

(57) ABSTRACT

A locking mechanism for a terminal position assurance (TPA) device is placed in-line with the TPA itself. The locking mechanism includes a pre-locking head and a final locking head. The final locking head is shorter than and face in an opposite direction from the pre-locking head. The orientation and geometry of the locking mechanism ensures a secure engagement of the TPA with the electrical connector assembly. Further, according to at least one embodiment, at least two pre-lock mechanisms and only a single final-lock mechanism may be provided for the locking mechanism to ensure a secure engagement of the TPA with the connector assembly without a false-positive engagement.

12 Claims, 4 Drawing Sheets

TERMINAL POSITION ASSURANCE LOCKING MECHANISM AND METHOD FOR OPERATING THEREOF

BACKGROUND OF THE INVENTION

The present invention generally relates to electrical connector systems utilizing a terminal position assurance (TPA) device which is removable from the connector assembly. More particularly, this invention is directed to a locking mechanism for ensuring the secure engagement of the TPA with the connector assembly.

Electrical connector systems typically include a TPA device which helps to create a more reliable interconnection. This member can be removable from the connector assembly, and thus requires the functionality to lock into place inside the housing. However, as connector systems and assemblies become smaller in size, it has become more difficult to provide an effective locking mechanism without also increasing the necessary size of the TPA.

The present invention provides an effective locking mechanism for a connector system without the necessity to increase the size of the connector assembly.

SUMMARY OF THE INVENTION

To fit an effective locking mechanism for a TPA into an electrical connector system, the locking mechanism may be placed in-line with the TPA itself. Further, both a pre-lock and a final-lock mechanism may be employed to ensure a secure engagement of the TPA with the electrical connector assembly. To achieve this, the pre-lock mechanism may be placed above the final-lock mechanism so that the pre-lock mechanism engages first, and the final-lock mechanism engages second as the TPA is inserted into the electrical connector. Further, according to at least one embodiment, it may be preferable to include at least two pre-lock mechanisms and only a single final-lock mechanism to ensure a secure engagement without a false-positive engagement.

BRIEF DESCRIPTION OF THE DRAWINGS

Advantages of embodiments of the present invention will be apparent from the following detailed description of the exemplary embodiments. The following detailed description should be considered in conjunction with the accompanying figures in which.

DETAILED DESCRIPTION OF THE PREFERRED EMBODIMENTS

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiment are not necessarily to be construed as preferred or advantageous over other embodiments. Moreover, the terms "embodiments of the invention", "embodiments" or "invention" do not require that all embodiments of the invention include the discussed feature, advantage or mode of operation.

Figure 1:
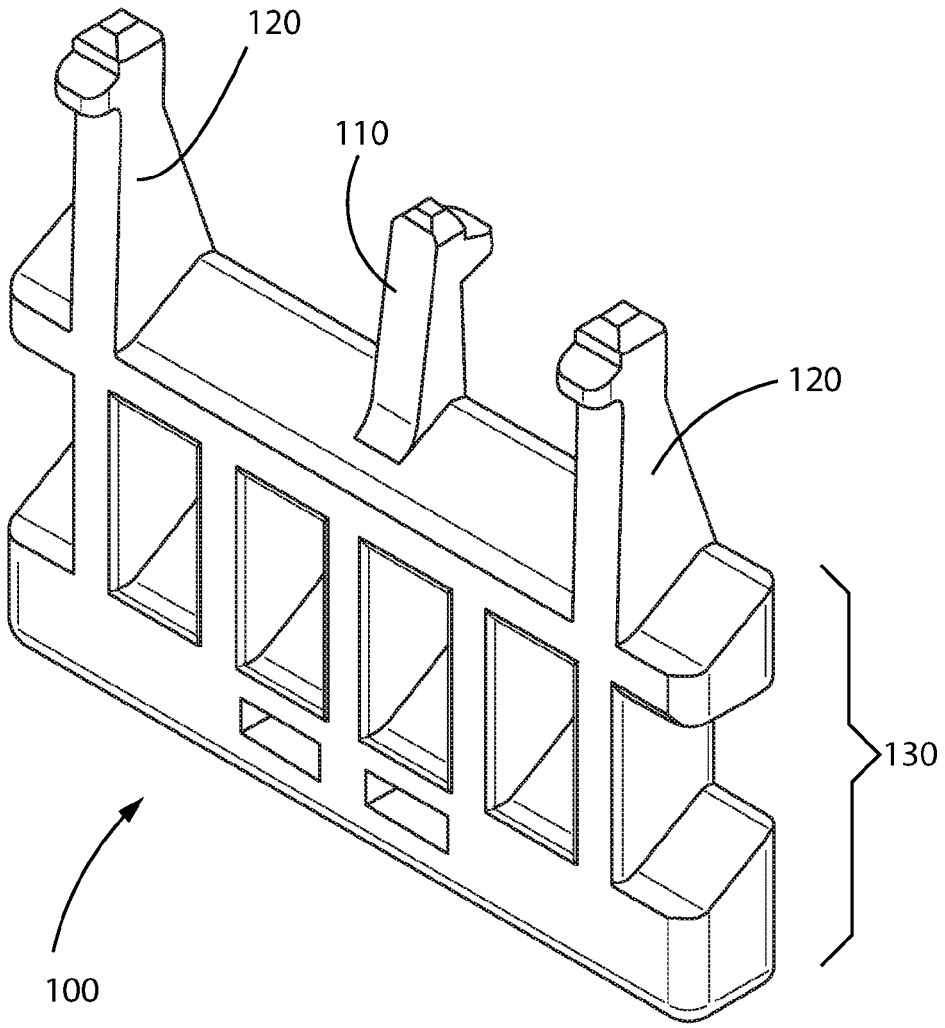
FIG. 1 shows an isometric view of a TPA with a locking mechanism of the present invention.
Figure 2A:
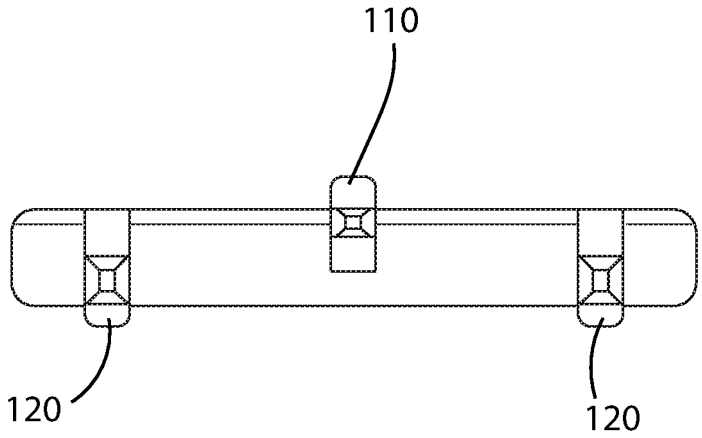
FIG. 2*a* shows a top view of a TPA with a locking mechanism of the present invention.
Figure 2B:
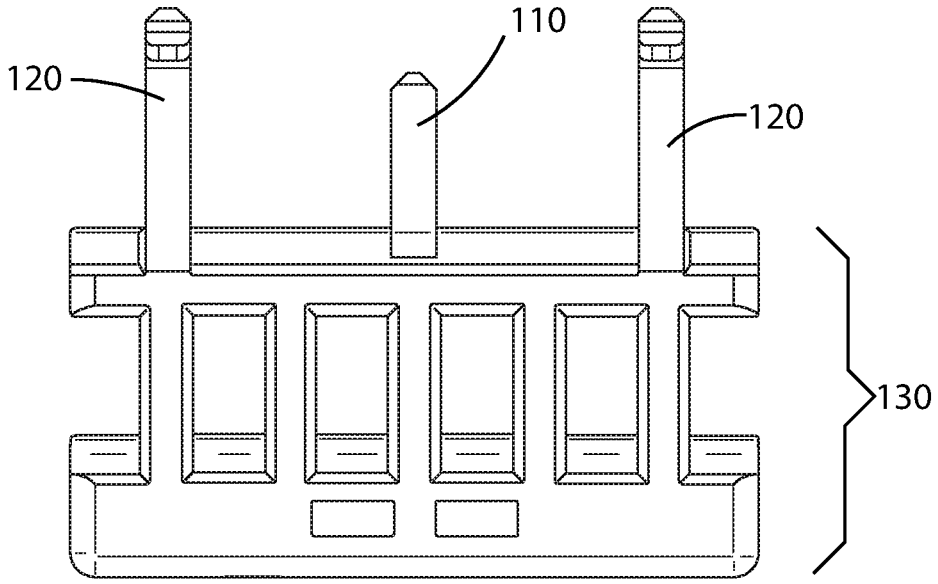
FIG. 2*b* shows a front elevation view of a TPA with a locking mechanism of the present invention.
Figure 2C:
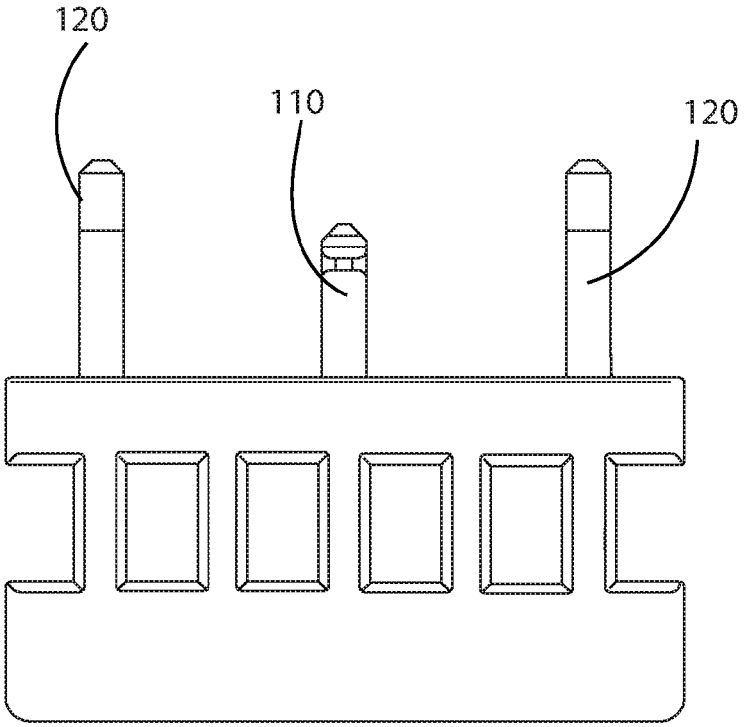
FIG. 2*c* shows a rear elevation view of a TPA with a locking mechanism of the present invention.
Figure 2D:
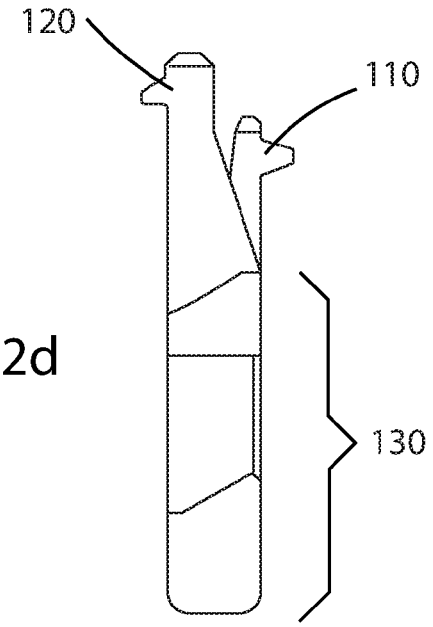
FIG. 2*d* shows a side elevation view of a TPA with a locking mechanism of the present invention.

Referring to exemplary FIGS. 1-2*d*, a TPA with a locking mechanism of the present invention 100 may include a final locking head 110, one or more pre-locking heads 120, and a body 130. In particular, the final locking head 110 may be shorter than and face in an opposite direction from the one or more pre-locking heads 120.

According to at least one exemplary embodiment, the TPA 100 has only a single final locking head 110 and has only two pre-locking heads 120. According to this embodiment, the single final locking head 110 may face in a first direction, for example towards the front or back of the TPA 100, and the two pre-locking heads 120 may face in a second direction which is opposite the first direction.

Further, the final locking head 110 and the one or more pre-locking heads 120 may be located on the top surface of TPA 100. This configuration may allow for the heads 110, 120 to engage with a connector assembly in line with the insertion direction of TPA 100 into a connector assembly, as described in more detail below.

Figure 3:
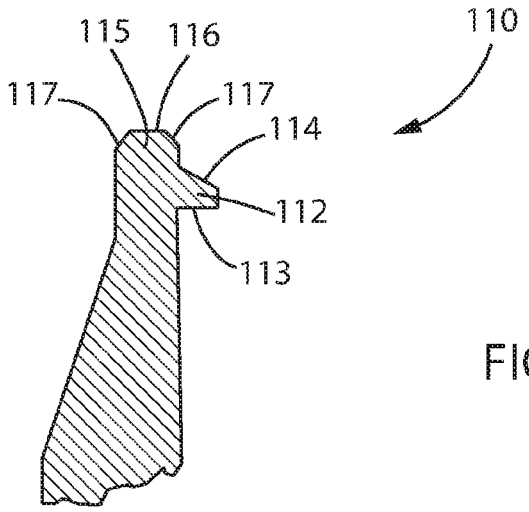
FIG. 3 shows a detail of a portion of a head for a locking mechanism of the present invention.

Referring now to exemplary FIG. 3, a detail of a final locking head 110 may be shown. Though the following description refers to final locking head 110, it is understood that pre-locking heads 120 may have similar and/or the exact same geometry for ease of production and design.

Final locking head 110 may have an engaging ridge 112 and a guiding head 115. Engaging ridge 112 may have a flat underside 113 and a topside 114. Engaging ridge 112 may provide the locking mechanism for final locking head 110 as once engaging ridge 112 is above an engaging portion of a connector assembly, flat underside 113 of ridge 112 prevents locking head 110 from moving in a downward direction. For example, flat underside 113 may extend in a direction substantially perpendicular from the insertion direction of TPA 100. Further, topside 114 may be inclined to assist ridge 112 to move past an engaging portion of a connector assembly as locking head 110 moves in an upward direction.

Guiding head 115 may have a flat upper portion 116 and inclined sides 117. The geometry of flat upper portion 116 and inclined sides 117 may assist in guiding final locking head 110 into a connector assembly. The flat upper portion 116 may, for example, extend in a direction substantially perpendicular to the insertion direction of TPA 100, and the inclined sides 117 may be inclined relative to flat upper portion 116 to create a convex insertion member.

As previously stated, the foregoing description and accompanying figure refers specifically to final locking head 110. However, it is understood that pre-locking heads 120 may have the same or similar construction.

Figure 4A:
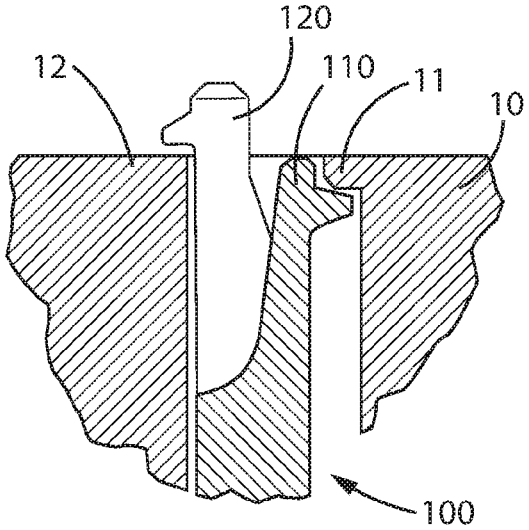
FIG. 4*a* shows a "pre-lock" configuration of a TPA with a locking mechanism of the present invention within a connector assembly.
Figure 4B:
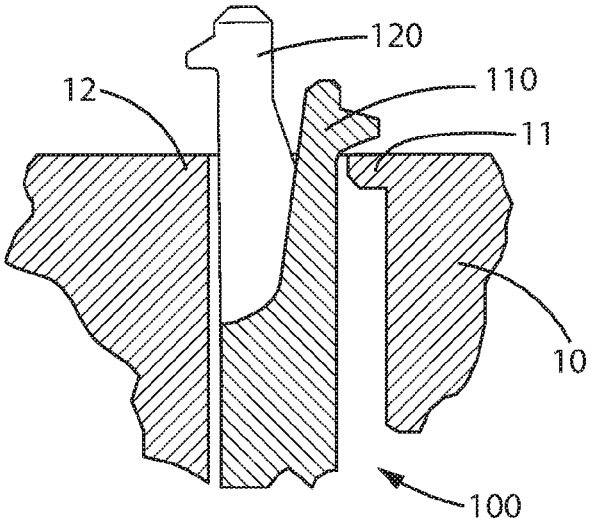
FIG. 4*b* shows a "final lock" configuration of a TPA with a locking mechanism of the present invention within a connector assembly.

Referring now to exemplary FIGS. 4*a* and 4*b*, the use of final locking head 110 and pre-locking heads 120 may be shown. FIG. 4*a* may show TPA 100 engaging in a pre-lock configuration with a connector assembly 10. Connector assembly 10 may have a final lock engaging portion 11 and a pre-lock engaging portion 12. In FIG. 4*a*, TPA 100 has been partially inserted into connector assembly 10 and pre-locking head 120 is engaged with pre-lock engaging portion 12. In this configuration, final locking head 110 is located below final lock engaging portion 11. In FIG. 4*b*, TPA 100 has been fully inserted into connector assembly 10 and final locking head 110 is engaged with final lock engaging portion 11. Pre-locking head 120 is now located above, and is no longer engaged with, pre-lock engaging portion 12.

By configuring TPA 100 with both of the pre-locking heads 120 and the final locking head 110, further assurance can be had that the TPA is properly and securely inserted into the connector assembly. Further, according to at least one exemplary embodiment, it is preferable to include only a single final locking head 110 to ensure there is no false-positive engagement of TPA 100 with connector assembly 10, and also to ensure that there is no situation where a half-mating occurs.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A terminal position assurance device, comprising:

a final locking head; and at least one pre-locking head, wherein the final locking head and the at least one pre-locking head are configured to mechanically engage with an electrical connector assembly, wherein the final locking head is positioned below the at least one pre-locking head, and wherein the final locking head is located in a substantially middle portion of the terminal position assurance device.

2. The terminal position assurance device according to claim 1 having only a single final locking head, the final locking head being located substantially between the pre-locking heads.

3. The terminal position assurance device according to claim 1, wherein the final locking head faces a first direction and the at least one pre-locking head faces a second direction which is substantially opposite the first direction.

4. The terminal position assurance device according to claim 1, wherein the final locking head comprises an engaging ridge, the engaging ridge further comprising:

a flat underside; and a topside, wherein the flat underside extends in a direction substantially perpendicular to an insertion direction of the terminal position assurance device, and wherein the topside is inclined relative to the flat underside.

5. The terminal position assurance device according to claim 1, wherein the final locking head comprises a guiding head, the guiding head further comprising:

a flat upper portion; and at least two inclined sides, wherein the flat upper portion extends in a direction substantially perpendicular to an insertion direction of the terminal position assurance device, and wherein the at least two inclined sides are inclined relative to the flat upper portion.

6. An electrical connector system, comprising:

a terminal position assurance device according to claim 1; and an electrical connector assembly, the electrical connector assembly further comprising a pre-lock engaging portion and a final-lock engaging portion, wherein, in a pre-lock state, the at least one pre-locking head mechanically engages with the pre-lock engaging portion and the final locking head is not engaged with the final-lock engaging portion, and wherein, in a final-lock state, the at least one pre-locking head mechanically is not engaged with the pre-lock engaging portion and the final locking head mechanically is engaged with the final-lock engaging portion.

7. A method for inserting a terminal position assurance device into an electrical connector assembly, comprising the steps of:

inserting the terminal position assurance device part-way into the electrical connector assembly to achieve a pre-lock state; and inserting the terminal position assurance device the entire way into the electrical connector assembly to achieve a final-lock state, wherein the terminal position assurance device comprises at least one pre-locking head and a final locking head, wherein the final locking head is located in a substantially middle portion of the terminal position assurance device, wherein, in the pre-lock state, the at least one pre-locking head is mechanically engaged with the electrical connector assembly and the final locking head is not engaged with the electrical connector assembly, and wherein, in the final-lock state, the at least one pre-locking head is not mechanically engaged with the electrical connector assembly and the final locking head is engaged with the electrical connector assembly.

8. The terminal position assurance device according to claim 1, wherein the final locking head and the pre-locking heads are in a substantially side-to-side arrangement along the terminal position assurance device.

9. The terminal position assurance device according to claim 1, wherein the final locking head includes an inclined side, the inclined side being a convex insertion member.

10. The method according to claim 7, wherein the final locking head is located substantially between the pre-locking heads.

11. The method according to claim 7, wherein the final locking head and the pre-locking heads are in a substantially side-to-side arrangement along the terminal position assurance device.

12. The method according to claim 7, wherein the final locking head includes an inclined side, the inclined side being a convex insertion member.

* * * * *